US005884373A

United States Patent [19]

Kawamura

[11] Patent Number: 5,884,373

[45] Date of Patent: Mar. 23, 1999

[54] AUTO-LOCK SLIDER FOR SLIDE FASTENER

[75] Inventor: Ryoji Kawamura, Toyama, Japan

[73] Assignee: YKK Corporation, Tokyo, Japan

[21] Appl. No.: 959,482

[22] Filed: Oct. 28, 1997

[30] Foreign Application Priority Data

Oct. 31, 1996 [JP] Japan ..... 8-290569

[51] Int. Cl.[6] ..... A44B 19/00

[52] U.S. Cl. ..... 24/421; 24/419; 24/424; 24/429

[58] Field of Search ..... 24/421, 422, 423, 24/424, 425, 419, 429

[56] References Cited

U.S. PATENT DOCUMENTS

| | | | |
|---|---|---|---|
| 3,239,905 | 3/1966 | Weiner | 24/421 |
| 4,081,883 | 4/1978 | Ishii et al. | 24/421 |
| 4,287,646 | 9/1981 | Kanizaka | 24/424 |
| 4,976,014 | 12/1990 | Akashi et al. | 24/429 |

FOREIGN PATENT DOCUMENTS

| | | |
|---|---|---|
| 0 576 985 A1 | 1/1994 | European Pat. Off. . |
| Sho 62-490 | 1/1987 | Japan . |
| 931149 | 6/1982 | U.S.S.R. . |
| 2 291 115 A | 1/1996 | United Kingdom . |

*Primary Examiner*—Victor N. Sakran
*Attorney, Agent, or Firm*—Hill & Simpson

[57] ABSTRACT

In an auto-lock slide fastener slider, a slider body has on an upper wing front and rear attachment lugs and at a position near the rear attachment lug between the two lugs a locking-pawl-insertion hole and in front of the hole a forwardly sloping guide surface. An axle of a pull tab is movably supported on the guide surface. Over the pull-tab axle, a locking leaf spring, which has at one end a locking pawl, at the other end a hook and at the center a resilient tongue punched out upwardly so as to form a longitudinal opening, is placed on the upper wing so as that the locking pawl is inserted in the hole while the hook is slidably engaged with the front lug, and that a central projection is loosely inserted through the opening 23. A cover is mounted on the front and rear lugs so as to define a gap between the cover and the front lug. When the spring is moved forwardly, the locking pawl comes into contact with a front wall of the hole, so that the locking pawl can be protected.

7 Claims, 4 Drawing Sheets

AUTO-LOCK SLIDER FOR SLIDE FASTENER

BACKGROUND OF THE INVENTION

1. Field of the Invention

This invention relates to an auto-lock slider, and more particularly to an auto-lock slide fastener slider composed of four members, i.e., a slider body, a pull tab, a locking leaf spring and a cover.

2. Description of the Related Art

FIG. 7 of the accompanying drawings shows a conventional auto-lock slide fastener slider which is disclosed in Japanese Utility Model Publication o. Sho 62-490. In this conventional auto-lock slider, the upper wing 5' of a slider body 1' has on its upper surface front and rear attachment lugs 10', 11', at a position near and forward of the rear attachment lug 11' a locking-pawl-insertion hole 141 and at a position forward of the locking-pawl-insertion hole 141 a pair of guide projections 15', the front attachment lug 10' having on its top a semi-cylindrical projection 12'. A locking leaf spring 3', which has at one end a slot 42 and at the other end a downwardly bent locking pawl 24' of which base portion is stepped so as to form a horizontal portion 41, is slidably mounted on the upper wing in such a manner that the slot 42 loosely receives the semi-cylindrical projection 12' of the front attachment lug 10 and that the horizontal portion 41 is disposed between the guide projections 15' of the upper wing 5'. An axle 19 of a pull tab 2' is inserted between the upper wing 5' and the locking leaf spring 3'. A cover 4' is attached to the attachment lugs 10', 11' over the locking leaf spring 3'.

According to the conventional auto-lock slider of FIG. 7, since the locking pawl 24', which is slidably mounted on the upper wing 5', does not come into contact with a front wall of the locking-pawl-insertion hole 141 when the locking leaf spring 3' is moved to the front side, the locking pawl 24' tends to deform so that a reliable locking operation cannot be achieved, thus causing a limited degree of durability.

SUMMARY OF THE INVENTION

A first object of this invention is to provide an auto-lock slide fastener slider in which a locking pawl of a locking leaf spring which is slidably mounted on the upper wing comes into contact with a front wall of a locking-pawl-insertion hole as it is moved forwardly in response to longitudinal movement of the locking spring, thus preventing the locking pawl from deforming due to the pressure of fastener elements and thereby enabling a reliable locking operation.

A second object of the invention is to provide an auto-lock slide fastener slider in which the spring can be held in a stabilized form on the slider body and is slidable longitudinally of the slider body.

A third object of the invention is to provide an auto-lock slide fastener slider in which the locking leaf spring can be moved smoothly and reliably due to a groove on the front attachment lug of the slider body or room in a cover mounted on the slider body.

A fourth object of the invention is to provide an auto-lock slide fastener slider in which the locking leaf spring can be supported in a stabilized form on the slider body without damage or trouble.

A fifth object of the invention is to provide an auto-lock slide fastener slider in which a pull tab can be reliably operated to unlock the slider with ease so that the slider may be slid smoothly to open and close a slide fastener.

According to a first aspect of the invention, there is provided an auto-lock slide fastener slider comprising: a slider body composed of upper and lower wings joined at their front ends by a guide post, the upper wing having a locking-pawl-insertion hole; a cover mounted on an upper surface of the upper wing; a locking leaf spring movably accommodated in the cover and having on its upper surface a resilient tongue and at one end a bent locking pawl, the locking leaf spring being movable longitudinally on the upper wing in such a manner that the locking pawl comes into contact with a front wall of the locking-pawl-insertion hole when the spring is slid forwardly; and a pull tab operatively connected to the locking leaf spring.

According to a second aspect of the invention, the upper wing has front and rear attachment lugs, to which the cover is attached, and the locking leaf spring has at the other end a hook bent in the same direction as the locking pawl and engaged with the front attachment lug.

According to a third aspect of the invention, the hook of the locking leaf spring is movable within a gap defined between the cover and the front attachment lug.

According to a fourth aspect of the invention, the locking leaf spring has an elongated opening formed by punching out the resilient tongue, and the front attachment lug has on its top a projection loosely received in the opening and at opposite sides of the projection a rearwardly sloping taper surface, on which both side edges of the opening are supported in such a manner that the locking leaf spring assumes an inclined posture.

According to a fifth aspect of the invention, the resilient tongue has a free end bent downwardly, while the front attachment lug has a groove between the taper surfaces in the rear of the projection for slidably receiving the free end of the resilient tongue.

According to a sixth aspect of the invention, the front attachment lug having in its front surface a vertical groove having a U-shape horizontal cross section, and the hook of the locking leaf spring being received so as to be movable in forward and rearward directions in the vertical groove.

According to a seventh aspect of the invention, the upper wing has between the locking-pawl-insertion hole and the front attachment lug a forwardly sloping guide surface for guiding an axle of the pull tab.

DETAILED DESCRIPTION OF THE PREFERRED EMBODIMENTS

Auto-lock slide fastener sliders according to preferred embodiments of this invention will now be described in detail with reference to the accompanying drawings.

Figure 1:
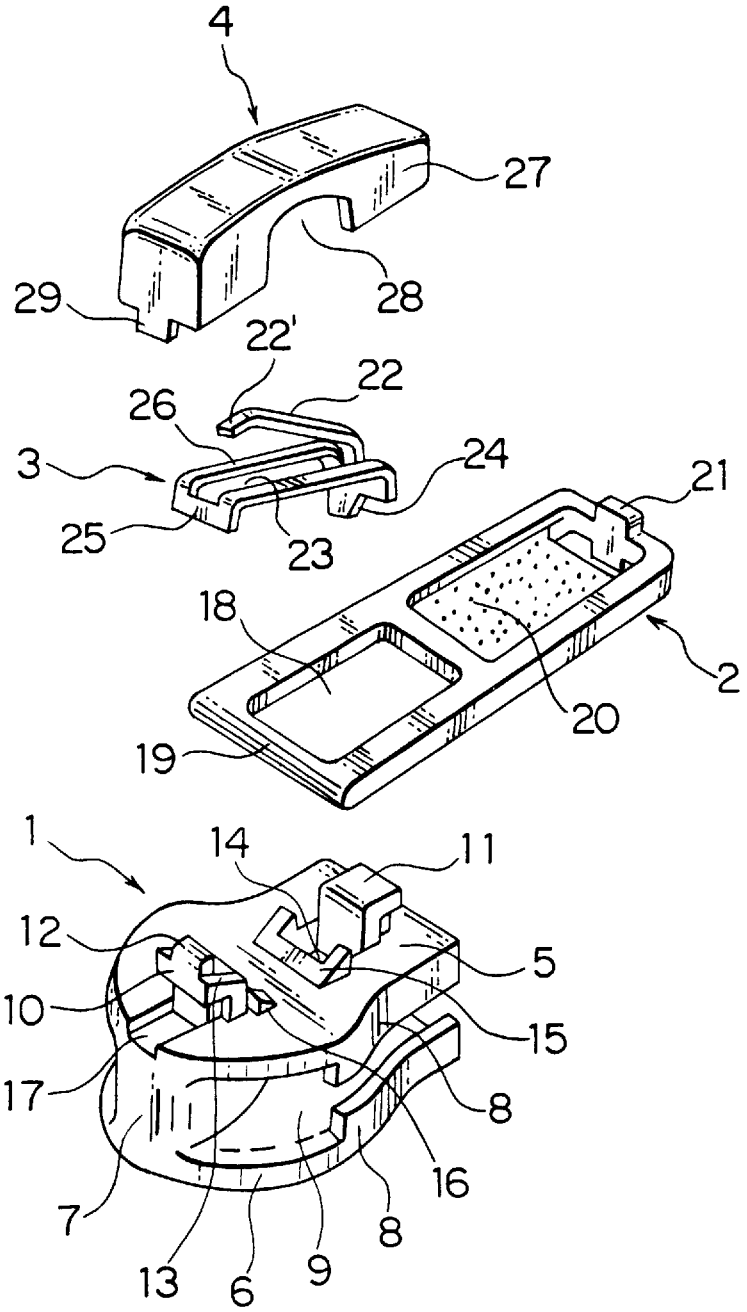
FIG. 1 is an exploded perspective view of an auto-lock slide fastener slider according to a first embodiment of this invention.

FIG. 1 shows an auto-lock slide fastener slider according to a first embodiment of the invention. In this embodiment, the auto-lock slider is assembled from four members, i.e., a slider body 1, a pull tab 2, a locking leaf spring 3 and a cover 4. The slider body 1, the pull tab 2 and the cover 4 are molded of metal, such as aluminum alloy or zinc alloy, by die casting, while the locking leaf spring 3 or the cover 4 is formed of a metal plate by pressing.

The slider body 1 is composed of upper and lower wings 5, 6 joined at their front ends by a guide post 7, each of the upper and lower wings 5, 6 having along opposite side edges a pair of side flanges 8 for guiding elements so as to define between the upper and lower wings 5, 6 an element guide channel 9. The auto-lock slider is suitable for a fastener chain in which a row of fastener elements is in the form of discrete fastener elements attached to each of confronting inner edges of opposite fastener tapes or in the form of a zigzag-shaped linear monofilament astride the fastener tape. Alternatively, for a fastener chain in which a row of fastener elements in the form of a coiled linear monofilament is attached to each of confronting inner edges of opposite fastener tapes, one of the upper and lower wings may be devoid of side flanges.

The slider body 1 has on the upper wing 5 front and rear attachment lugs 10, 11 for attaching the cover 4. The front attachment lug 10 has on its top surface a central projection 12, at each of opposite sides of the central projection 12 a taper surface 13 gradually sloping toward a rear end of the slider for supporting the locking leaf spring 3, and also a groove 32 between the taper surfaces 13 in the rear of the projection 12. The groove 32 is formed at such a position as to corresponds to a downwardly bent free end 22' of a resilient tongue 22 of the leaf spring 3, which will be described later, when the spring 3 is mounted on the front attachment lug 10.

Also the upper wing 5 has, in a position near the rear attachment lug 11 and toward the front attachment lug 11, a locking-pawl-insertion hole 14 communicating with the element guide channel 9, and at a position between the locking-pawl-insertion hole 14 and the front attachment lug 10, a guide surface gradually sloping 15 for guiding an axle 19 of the pull tab 2. At a position rearward of the front attachment lug 10, the upper wing 5 has a pair of laterally aligned small projections 16 extends so that the axle 19 of the pull tab 2 can be supported in a stabilized posture between the guide surface 15 and the small projections 16. At a position near the front attachment lug 10 and toward the front end of the slider body 1, the upper wing 5 has in its upper surface a longitudinal groove 17.

The pull tab 2 is in the form of a rectangular plate according to this embodiment, but may be in any of various forms. The illustrated pull tab 2 has in one end portion an elongated opening 18 through which the cover 4 can be inserted and across one end of which the axle 19 extends, and in the other end portion a pair of gripping portions 20 each being on each side thereof and in a form of recess. Also the pull tab 2 has at one end a pair of end projections 21 extending in opposite directions for an automatic assembling process.

The locking leaf spring 3 is in the form of a rectangular plate having a longitudinal resilient tongue 22, which is punched out upwardly so as to form a central elongated opening 23. The resilient tongue 22 also has a downwardly bent free end 22' which is prevented from being caught in the inner surface of the cover 4 and makes a smooth sliding of the free end 22' when the spring 3 slides. Thus, the resilient tongue 22 resiliently contact with an inner surface of the cover 4 when assembled. Also the locking leaf spring 3 has at one end a downwardly bent locking pawl 24, which is to be inserted in the locking-pawl-insertion hole 14, and at the other end a downwardly bent hook 25, which is to be engaged with the front attachment lug 10. Further, opposite side edges 26 of the elongated opening 23 are formed so as to be supported on the taper surface 13 on the top of the front attachment lug 10.

The cover 4 is in the form of an elongated box having in opposite side walls 27 a pair of laterally aligned cutouts 28, through which the axle 19 of the pull tab 2 is to be inserted, and at the lower portion of a front wall a downwardly extending front projection 29, which is to be fitted in the longitudinal groove 17 of the upper wing 5, so that the cover 4 is attached to the front and rear attachment lugs 10, 11 so as to cover the front and rear attachment lugs 10, 11, defining a gap 30 between the inner surface of the front wall of the cover 4 and the front attachment lug 10.

For assembling the slider, the axle 19 of the pull tab 2 is placed between the guide surface 15 and the small projections 16 on the upper wing 5, and then the locking leaf spring 3 is placed over the axle 19 of the pull tab 2 with the locking pawl 24 inserted in the locking-pawl-insertion hole 14 and with the hook 25 engaged with the front attachment lug 10. At that time, the projection 12 on the top of the front attachment lug 10 is received in the elongated opening 23 of the locking leaf spring 3, and the opposite side edges 26 of the elongated opening 23 of the locking leaf spring 3 are supported on the sloping taper surface 13 on the top of the front attachment lug 10. Then, the cover 4 is placed so as to cover the front and rear attachment lugs 10, 11 with the front projection 29 received in the longitudinal groove 17 of the upper wing 5, and then the opposite side walls 27 of the cover 4 is clenched against the front and rear attachment lugs 10, 11, thus finalizing the assembling of the slider 1.

Figure 2:
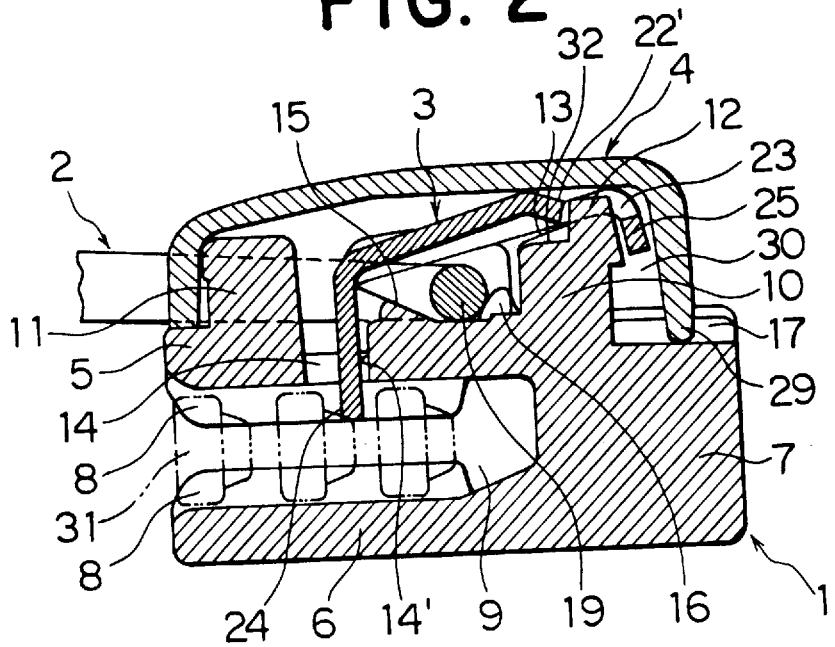
FIG. 2 is a longitudinal cross-sectional view showing the slider having been locked.
Figure 3:
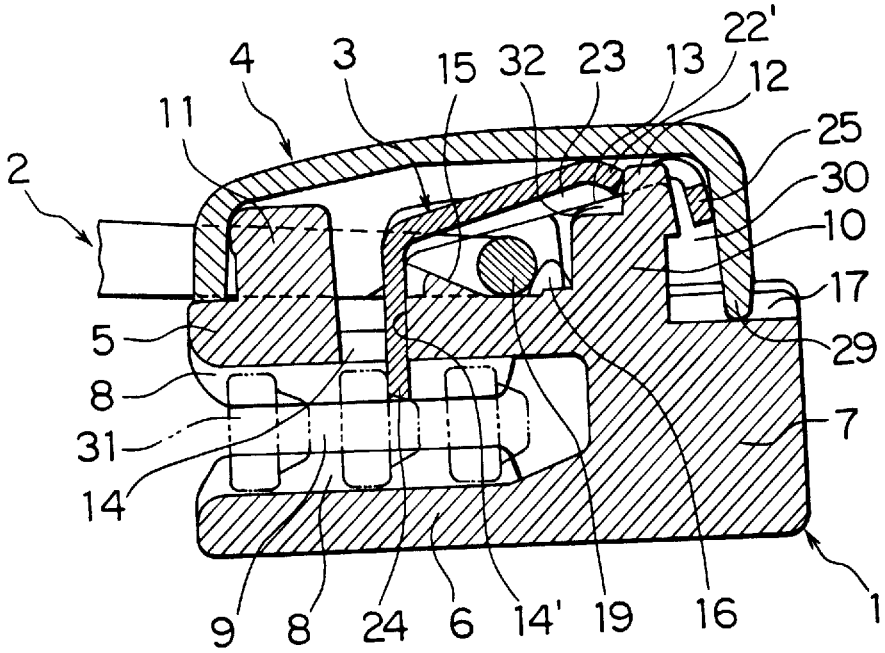
FIG. 3 is a longitudinal cross-sectional view similar to FIG. 2, but showing a locking pawl is moved to the front side while the slider is locked.
Figure 4:
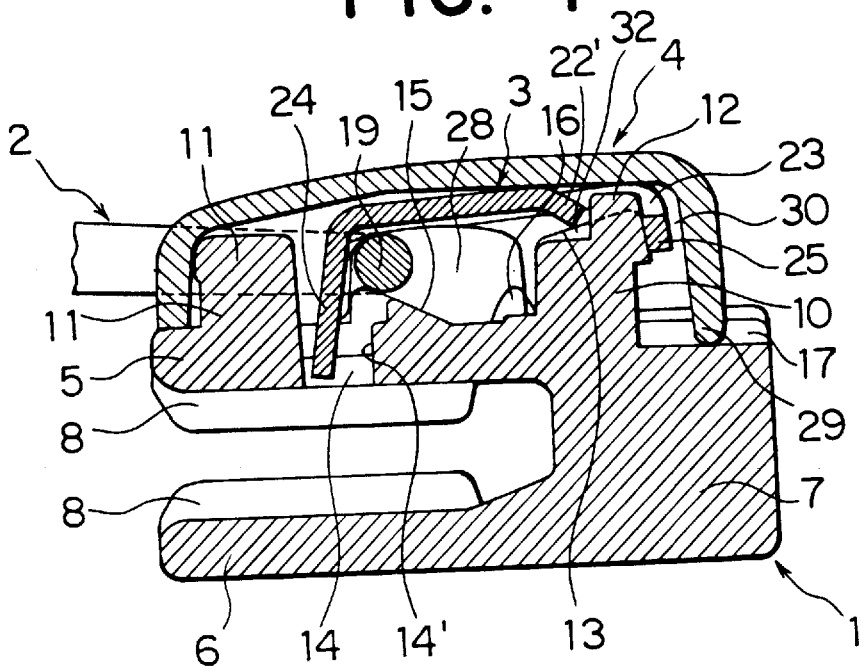
FIG. 4 is a longitudinal cross-sectional view showing the slider having been unlocked.

In operation, when the pull tab 2 is pulled forwardly and upwardly, the locking leaf spring 3 is raised to remove the locking pawl 24 from the space between adjacent fastener elements 31 so that the slider can be slid on the fastener chain to close the slide fastener. If the pull tab 2 is released, the locking pawl 24 of the locking leaf spring 3 is inserted into the space between adjacent fastener elements 31 by the action of the resilient tongue 22 so that the slider is prevented from sliding on the fastener chain as shown in FIG. 2. If a load in the direction of opening the slide fastener is exerted on the slider body 1 while the slider is locked, though the slider body 1 is moved backwardly to some extent until the locking pawl 24 comes into contact with the front wall 14' of the locking-pawl-insertion hole 14, as shown in FIG. 3, thus further movement of the slider is prevented. If the pull tab 2 is pulled backwardly, the axle 19 is moved along the guide surface 15 and, as a result, the locking leaf spring 3 is raised to remove the locking pawl 24 from the space between adjacent fastener elements 31 as shown in FIG. 4 so that the slider can slide on the fastener chain to open the slide fastener.

Figure 5:
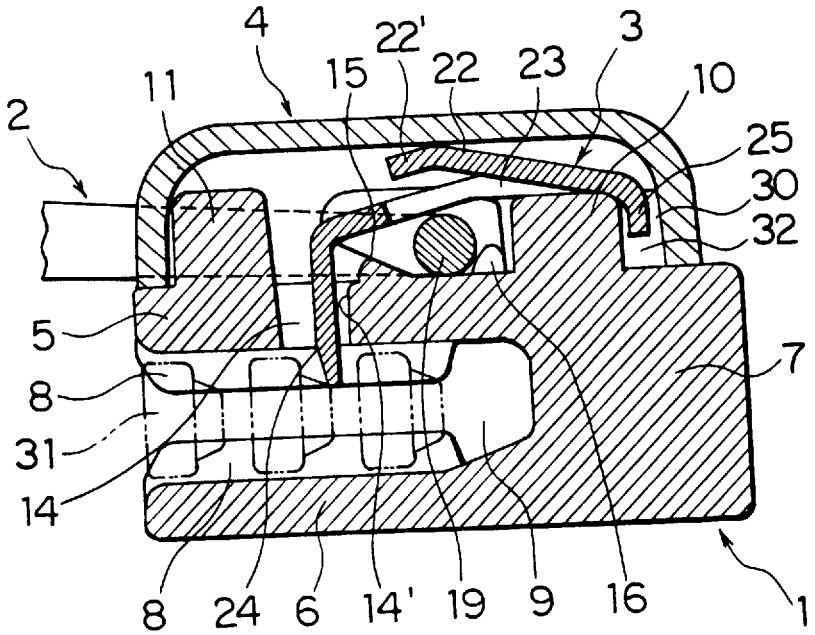
FIG. 5 is a longitudinal cross-sectional view of a modified auto-lock slider according to a second embodiment of the invention, showing the slider in a locked posture.

FIG. 5 shows a modified auto-lock slide fastener slider according to a second embodiment of the invention, which is identical in construction with the slider of the first embodiment except that the front attachment lug 10 on the upper wing 5 and the locking leaf spring 3 are modified. The modified front attachment lug 10 has on its top no projection and in its front surface a vertical groove 32 defining a gap 30 and having a depth larger than the thickness of the modified locking leaf spring 3.

Figure 6:
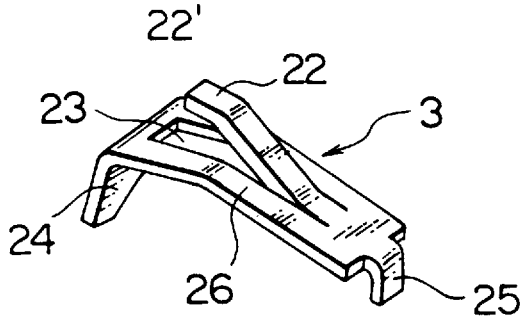
FIG. 6 is a perspective view of a locking leaf spring to be used in the slider of FIG. 5.
Figure 7:
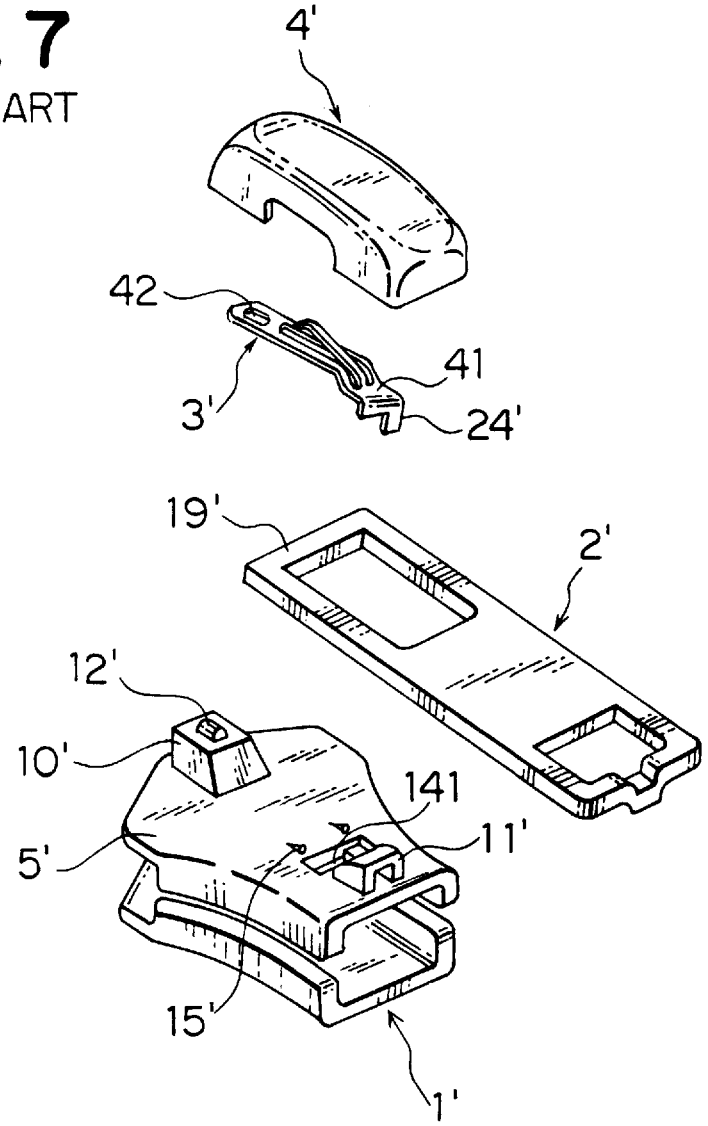
FIG. 7 PRIOR ART
FIG. 7 is an exploded perspective view of a conventional auto-lock slide fastener slider.

As shown in FIG. 6, the modified leaf spring 3 is in the form of an elongated rectangular plate having at one end a downwardly bent locking pawl 24 and at the other end a downwardly bent small-width hook 25. Likewise the first embodiment, the modified leaf spring 3 also has a resilient tongue 22 punched out upwardly from a portion of the rectangular plate toward a hook 25 so as to form a central elongated opening 23.

For assembling the modified slider, the locking leaf spring 3 is placed on the upper wing 5. in such a manner that the hook 25 is engaged in the vertical groove 32 so as to be movable within the gap 30 and that the opposite side edges 26 of the elongated opening 23 are supported on the flat top surface of the front attachment lug 10. The locking pawl 24 is inserted in the locking-pawl-insertion hole 14, and over the locking leaf spring 3, the cover 4 is attached to the front and rear attachment lugs 10, 11 in such a manner that the resilient tongue 22 of the locking leaf spring 3 resiliently touches the inner surface of the ceiling of the cover 4.

With the auto-lock slide fastener slider of this invention, the following advantageous results can be achieved.

According to the first aspect of the invention, since the upper wing 5 of the slider body 1, on which a cover 4 is mounted, has a locking-pawl-insertion hole 14, while a locking leaf spring 3, which is accommodated in the cover 4 and has on its upper surface a resilient tongue 22 and at the other end a bent locking pawl 24, is movable longitudinally on the upper wing 5, and since the locking pawl 24 comes into contact with a front wall 14' of the locking-pawl-insertion hole 14 when spring 3 is moved forwardly, the locking pawl 24 is prevented from deforming even when a load is exerted on the pawl 24 due to coupling elements, thus realizing a reliable locking operation.

According to the second aspect of the invention, since the upper wing 5 has front and rear attachment lugs 10, 11, to which the cover 4 is attached, and the locking leaf spring 3 has at the other end a hook 25 which is bent in the same direction as the locking pawl 24 and slidably engaged with the front attachment lug 10, it is possible to hold the locking leaf spring 3 slidably in a stabilized posture, thus achieving a smooth locking operation.

According to the third aspect of the invention, since the hook of the locking leaf spring 3 is movable within the gap 30 defined between the cover 4 and the front attachment lug 10, the locking leaf spring 3 can be moved smoothly and reliably within the cover 4.

According to the fourth aspect of the invention, since the locking leaf spring 3 has an elongated opening 23 formed by punching out a resilient tongue 22, and the front attachment lug 10 has on its top a projection 12 loosely received in the opening 23 and at opposite sides of the projection 12 a rewardly sloping taper surface 13, on which both side edges 26 of the opening 23 is supported in such a manner that the locking leaf spring 3 assumes an inclined posture, it is possible to hold the spring 3 in a stabilized posture on the slider body 1, thus keeping the spring 3 free from damage or trouble and therefore improving the durability.

According to the fifth aspect of the invention, due to the existence of the groove 32, the end 22' of the resilient tongue 22 is prevented from touching an upper surface of the front attachment lug 10 when the leaf spring 3 slides forwardly and backwardly or pivotally moves vertically, thus achieving a smooth movement of the spring 3.

According to the sixth aspect of the invention, since the front attachment lug 10 has in its front surface a vertical groove 32 having a U-shape horizontal cross section, in which the hook 25 of the locking leaf spring 3 is received so as to be movable in forward and reward directions, it is possible to hold the spring 3 on the slider body 1 stably and easily, and to position the spring 3 so as not to be damaged, thus improving the durability.

According to the seventh aspect of the invention, since the upper wing 5 of the slider body 1 has a forwardly sloping guide surface 15 in front of the locking-pawl-insertion hole 14, it is possible to raise the locking leaf spring 3 easily and reliably by the action of the pull tab 2, thus unlocking the pawl 24, so that the slider can be slid smoothly on the fastener chain.

What is claimed is:

1. An auto-lock slide fastener slider comprising:

(a) a slider body composed of upper and lower wings joined at their front ends by a guide post, said upper wing having a locking-pawl-insertion hole;

(b) a cover mounted on an upper surface of said upper wing;

(c) a locking leaf spring movably accommodated in said cover and having on its upper surface a resilient tongue and at one end a bent locking pawl, said locking leaf spring having a longitudinal opening extending along the entire length thereof so that the spring is movable longitudinally on said upper wing in such a manner that said locking pawl contacts all of a front wall of said locking-pawl-insertion hole when said spring is moved forwardly; and (d) a pull tab operatively connected to said locking leaf spring.

2. An auto-lock slide fastener slider according to claim 1, wherein said upper wing has front and rear attachment lugs, to which said cover is attached, and said locking leaf spring has at the other end a hook bent in the same direction as said locking pawl and slidably engaged with said front attachment lug.

3. An auto-lock slide fastener slider according to claim 2, wherein said hook is movable within a gap defined between said cover and said front attachment lug.

4. An auto-lock slide fastener slider according to claim 2, wherein said locking leaf spring has an elongated opening formed by punching out said resilient tongue, and said front attachment lug has on its top a projection loosely received in said opening and at each of opposite sides of said projection a rearwardly sloping taper surface, on which both side edges of said opening are supported in such a manner that said locking leaf spring assumes an inclined posture.

5. An auto-lock slide fastener slider according to claim 4, wherein said resilient tongue has a free end bent downwardly, while said front attachment lug has a groove between the taper surfaces in the rear of the projection for slidably receiving said free end of said resilient tongue.

6. An auto-lock slide fastener slider according to claim 2, wherein said front attachment lug having in its front surface a vertical groove having a U-shape horizontal cross section, and said hook of said locking leaf spring being received so as to be movable in forward and reward directions in said vertical groove.

7. An auto-lock slide fastener slider according to claim 1, wherein said upper wing has between said locking-pawl-insertion hole and said front attachment lug a forwardly sloping guide surface for guiding an axle of said pull tab.

* * * * *